US006862830B2

(12) United States Patent
Pagnoncelli

(10) Patent No.: US 6,862,830 B2
(45) Date of Patent: Mar. 8, 2005

(54) SAFETY DEVICE FOR GUNS

(75) Inventor: Jamir Pagnoncelli, Canoas (BR)

(73) Assignee: Forjas Taurus S.A., Porto Alegre (BR)

( * ) Notice: Subject to any disclaimer, the term of this patent is extended or adjusted under 35 U.S.C. 154(b) by 0 days.

(21) Appl. No.: 10/656,681

(22) Filed: Sep. 5, 2003

(65) Prior Publication Data

US 2004/0118029 A1 Jun. 24, 2004

(30) Foreign Application Priority Data

Sep. 6, 2002 (BR) ..... 0203776

(51) Int. Cl.[7] ..... F41A 17/74
(52) U.S. Cl. ..... 42/70.08; 42/66; 89/148
(58) Field of Search ..... 42/70.08, 70.01, 42/70.11, 66; 89/148

(56) References Cited

U.S. PATENT DOCUMENTS 3,803,741 A * 4/1974 Ducommun ..... 42/66
4,615,133 A * 10/1986 Center ..... 42/69.01
5,335,437 A * 8/1994 Andersen ..... 42/70.08
5,910,003 A * 6/1999 Kleinpaul ..... 42/70.11
6,629,379 B1 * 10/2003 Doiron ..... 42/70.11
2002/0088160 A1 * 7/2002 Beretta ..... 42/70.08
2002/0148152 A1 * 10/2002 Curry et al. ..... 42/66

FOREIGN PATENT DOCUMENTS

DE 555 758 * 7/1932 ..... 42/70.08
DE 31 32 284 A1 * 2/1983

* cited by examiner

*Primary Examiner*—Stephen M. Johnson
(74) *Attorney, Agent, or Firm*—Baschman & LaPointe, P.C.

(57) ABSTRACT

Safety device for guns which can be activated by a special key, which is incorporated to the hammer in gun models in which the hammer just protrudes from its lodging slot in the frame, being constituted by a safety acting by direct obstruction of the movement of the gun hammer, with the purpose to avoid accidents when the gun is handled by other persons than the owner which has a special key.

9 Claims, 9 Drawing Sheets

SAFETY DEVICE FOR GUNS

BACKGROUND OF THE INVENTION

The invention refers to a safety device, which can be actuated by a special key, which is incorporated to the hammer of gun models in which said hammer just protrudes from its shelter slot in the frame.

Various kinds of gun safety are known, from which we can particularly mention PI 9604463.2, which are different from the current application since they generally refer to common guns with exposed hammer.

SUMMARY OF THE INVENTION

The present gun model with protruding hammer, differently from hammerless guns which can only shot under double action, can also shot under single action, when the gun is previously cocked by the thumb, acting over the corresponding serrated surface of the hammer. Therefore, the safety device object of the invention can be actuated by means of a special key, be the gun uncocked (resting hammer) or cocked for single action shot. In both situations, the circular head of the safety which is located in the hammer should be turned 180° clockwise by means of the special key. This will cause the lifting of the safety head, making it protuberate with relation to the serrated surface of the hammer, thus defining gun deactivation, both visually and by touch. Hammer movements being restrained cause said deactivation.

The safety device object of the invention is constituted by safety acting by directly obstructing the movement of the gun hammer, with the purpose to avoid accidents when other persons than the owner which has the special safety key handle the gun.

It should be highlighted that the object of the invention especially refers to hammerless guns, which frame has a format fully lodging the hammer, being different because, in this case, said frame has a slot in its higher curved part allowing a small rectangular and serrated face of the hammer to protrude.

In the front part of said face, there is the circular safety head provided with a peculiar orifice solely allowing to insert the special key to operate said safety. In the description of this patent, it will be clear that the safety, when activated in the uncocked position, will avoid the hammer cocking by both thumb and the trigger. If the gun hammer is cocked (cocked gun), the safety, when activated, will avoid accidental shots under single action (contact of the trigger with clothes), since it will block the course of the hammer before percussion.

The safety when activated and therefore protuberant from the hammer when turned 180° clockwise by means of the special key can be deactivated by the same key under any of the mentioned situations, by simply turning it 180° anticlockwise, when it will again be inserted in the corresponding lodging until its head matches the serrated surface of the hammer. Said axial movement of the safety, when turned, is the result of an interaction between a helical recess on the surface of the cylindrical body of said safety with a crosswise pin fixed to the hammer. Said safety movements make the lower end of its cylindrical body interfere or not with an appropriate stopping pin fixed to the frame. As a result, in case of interference, the hammer cannot be normally operated to effect shots and, in case of no interference, shots are allowed.

Both positions, activated and deactivated, of the present safety device are characterized and assured thanks to an appropriate mechanical system constituted by a small sphere and corresponding spring, located in a crosswise orifice of the cylindrical body of the safety. The system acts by interference between the sphere and two opposed cavities located at different heights in the internal face of the lodging of said body. Thus, both safety positions, activated and inactivated, are clearly determined.

BRIEF DESCRIPTION OF THE DRAWINGS

The safety device for gun object of the invention will be better understood in the light of the description made with reference to the attached figures showing a preferential but not restrictive form of the invention, in which.

DETAILED DESCRIPTION

Figure 1:
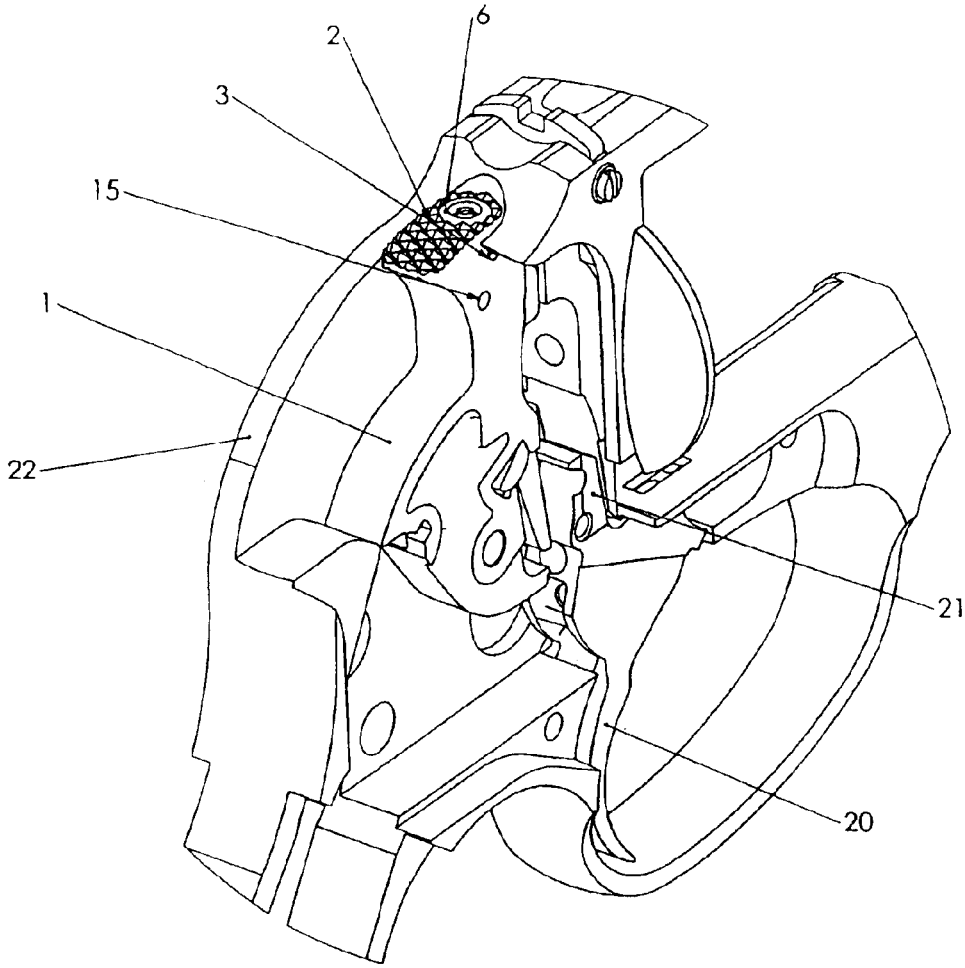
FIG. 1 corresponds to a perspective view of the gun frame partially cut, showing the hammer and the main components of the proposed safety system.

According to the attached figures, the small serrated higher face (2), mainly plane of the hammer (1), just protrudes from the curved back (22) of the frame, along the whole movement of the hammer (1).

From the frontal part of the face (2) of the hammer (1), the cylindrical head (6) of the safety (5) protrudes and can be fully lodged in the hole (19) of the hammer.

The safety is formed by the cylindrical head (6) with larger diameter and the prolonged cylindrical body (5). The head is provided on its upper side with a cylindrical hole (7) which is limited below by a hexagonal orifice (8). From the base of the hexagonal orifice, a cylindrical pin (9) is projected and limited upwards by a small depression (10) located below the higher face of the head (6) having rounded edges.

The cylindrical head (6) is also provided with a diametrical non-through hole (11), in which the spring (12) and the sphere (13) of the safety positioning system are inserted in relation to its lodging (19) in the hammer (1), in which internal cylindrical face there are two positioning cavities (3) and (4), diametrically opposed and in different heights.

Just below the head (6) in the cylindrical body (5) of the safety, there is a helical recess (16) which, by interacting with the cylindrical pin (15) fixed crosswise in the hammer, causes the lowering and lifting movements of the safety when turned 180° clockwise or anticlockwise by means of a special key which is insertable in hole (7) over pin (9).

Figure 2:
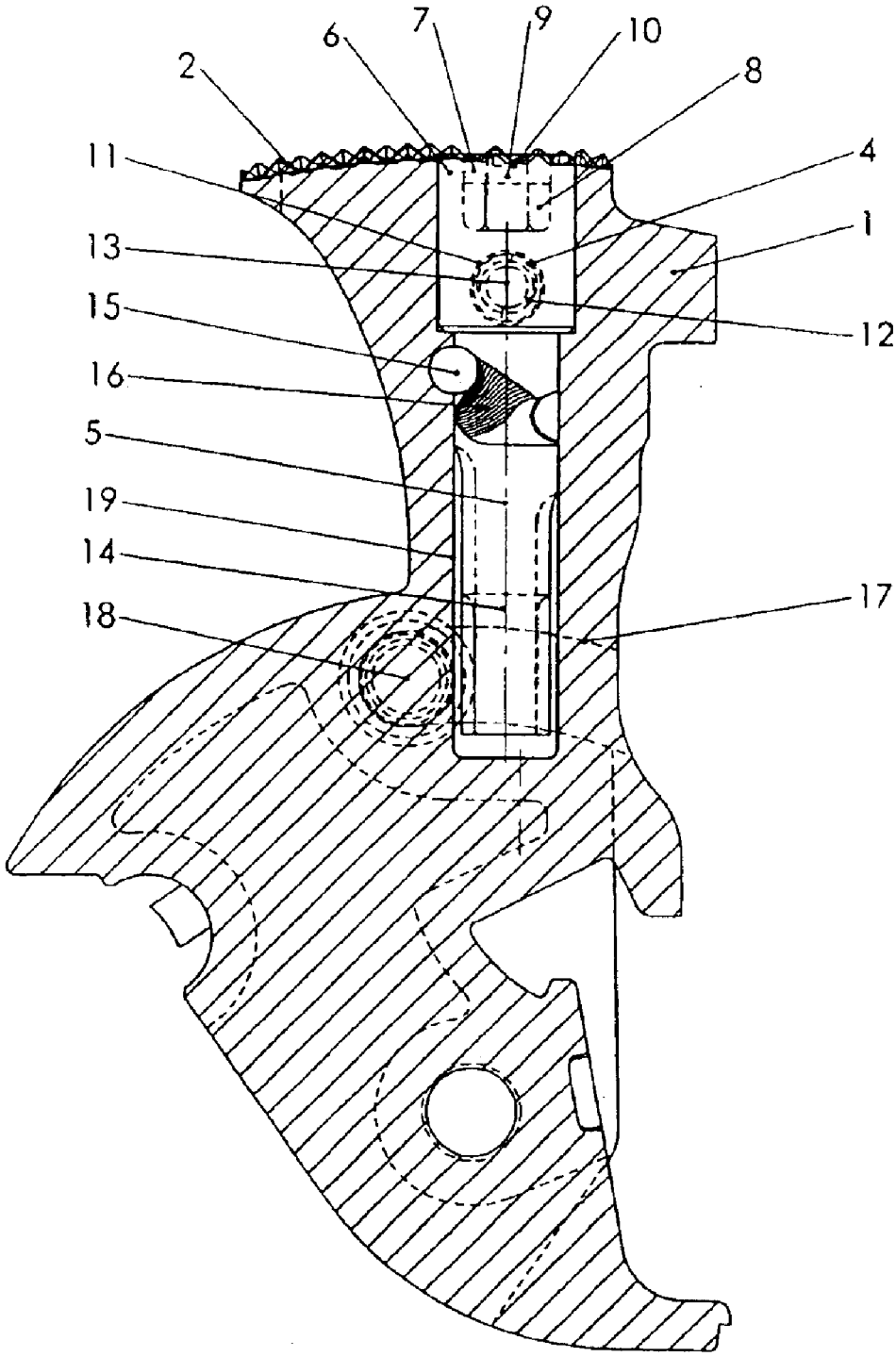
FIG. 2 is a cut right side view in medium front plan of the hammer, in the uncocked and unlocked position.
Figure 3A:
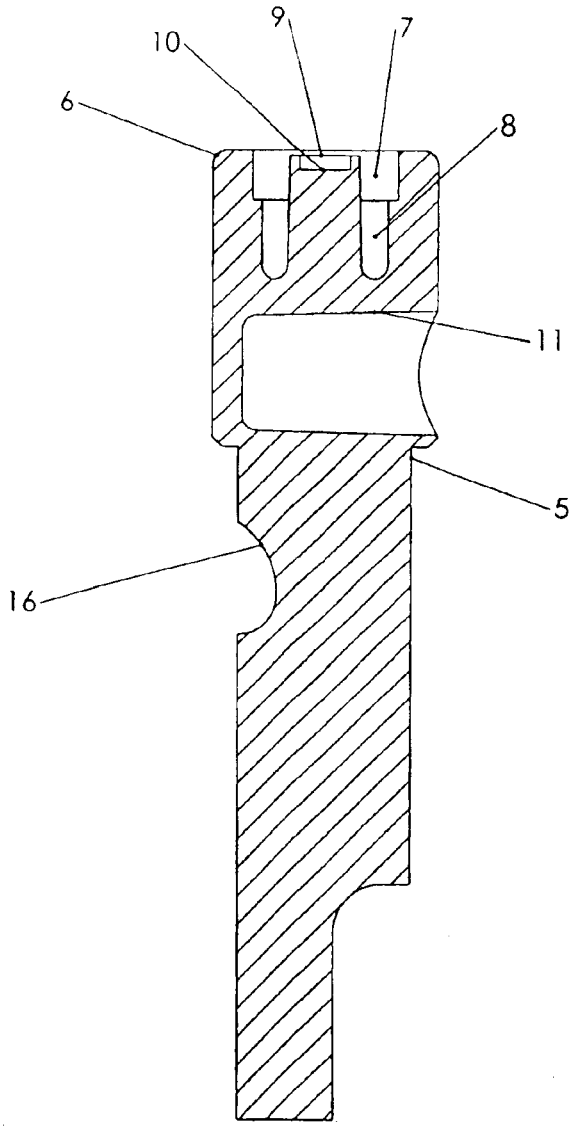
FIG. 3*a* is a partial perspective of the safety head and FIG. 3*b* is a cut view of the whole body, respectively.
Figure 3B:
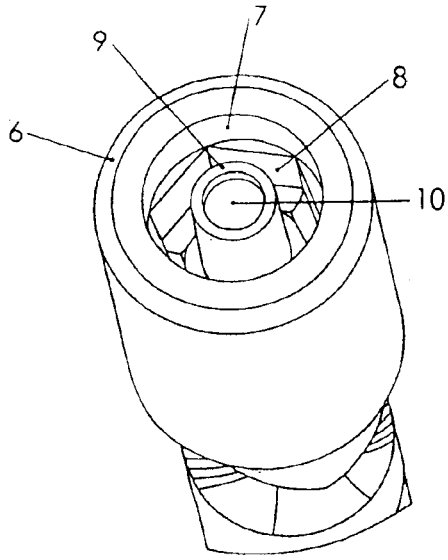
Figure 4:
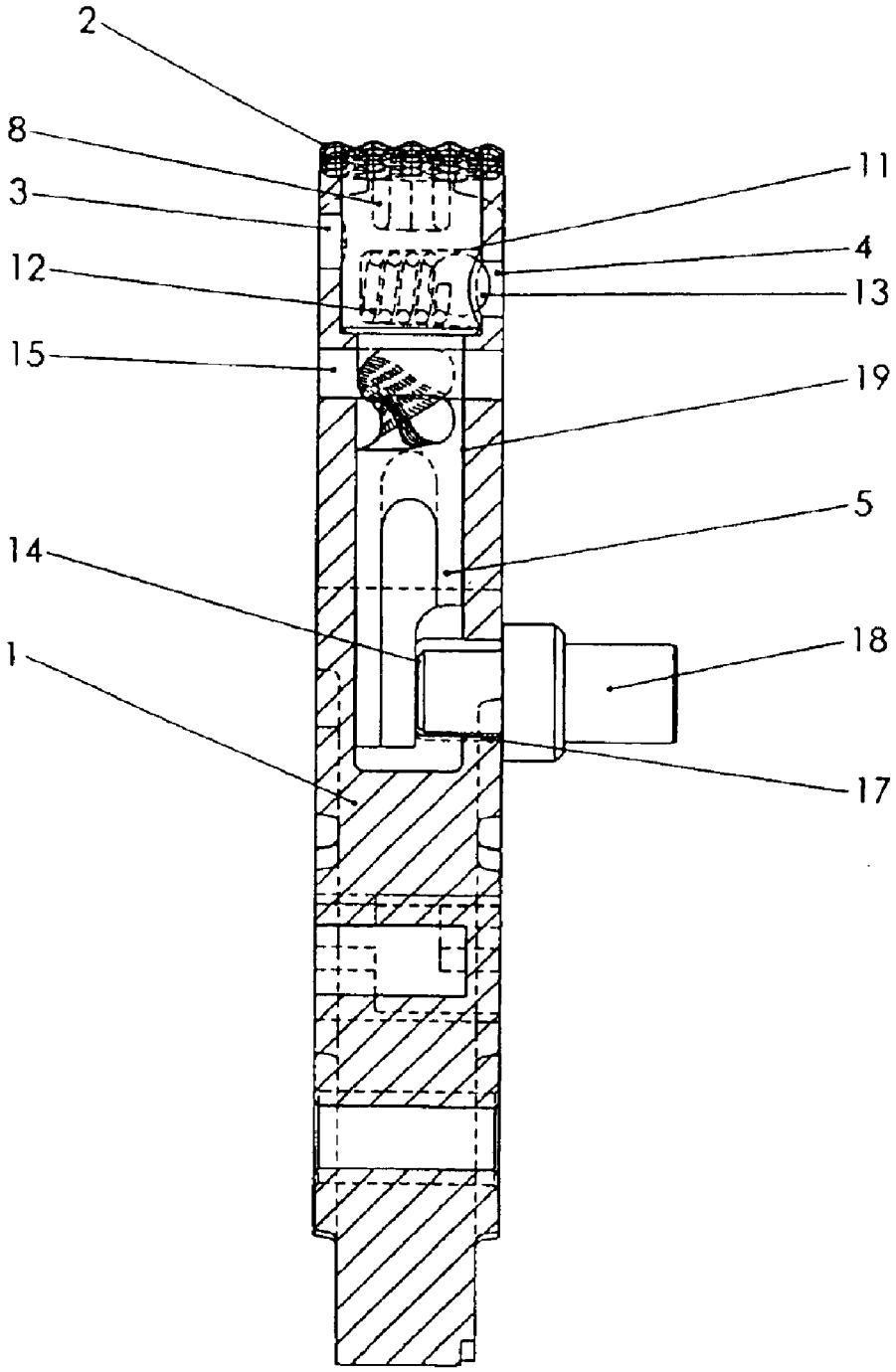
FIG. 4 is a front cut view of the hammer in the position represented by FIG. 2.
Figure 5:
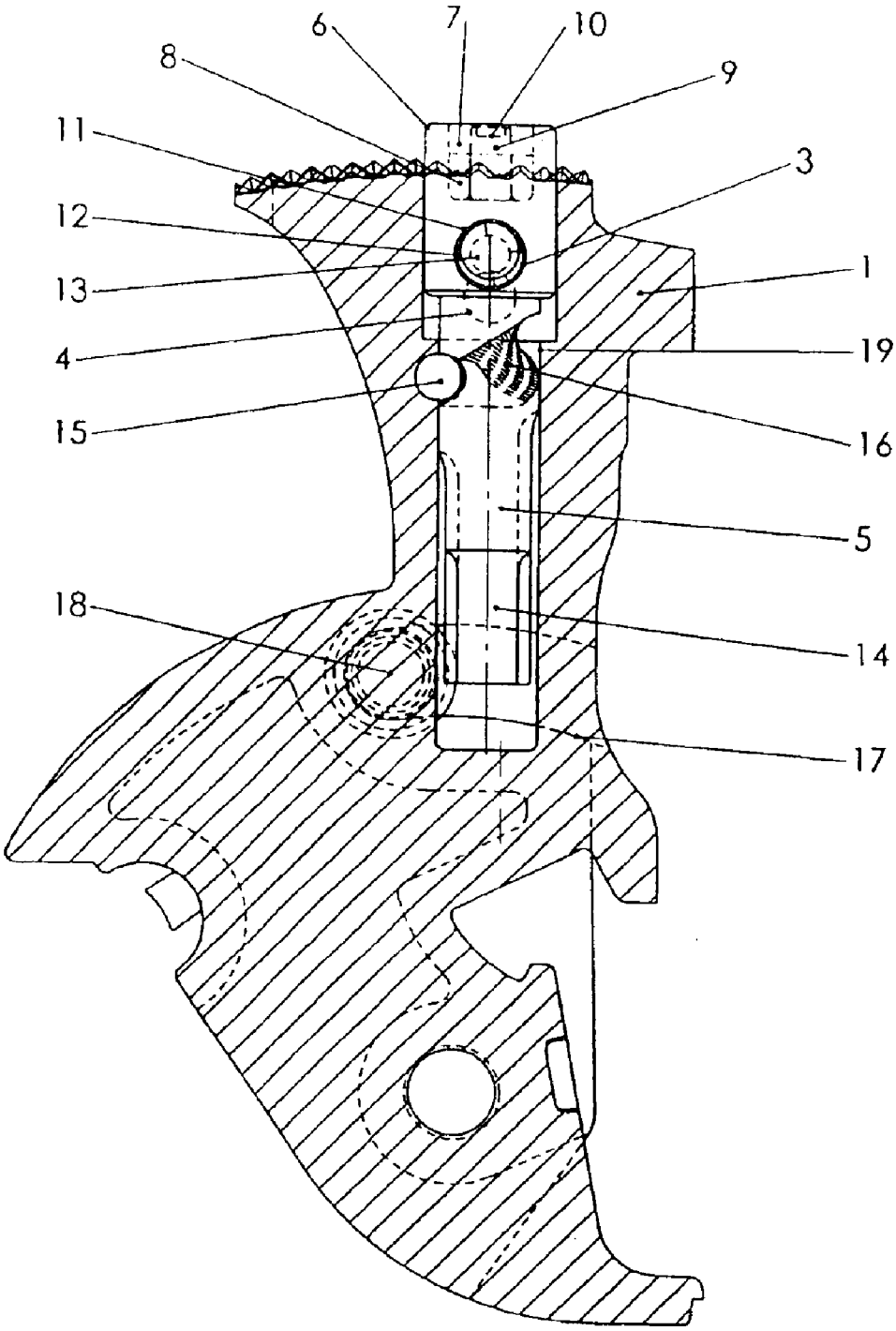
FIG. 5 is a cut right side view in medium plan of the hammer, now in the uncocked but locked position, under which it cannot be cocked.
Figure 6:
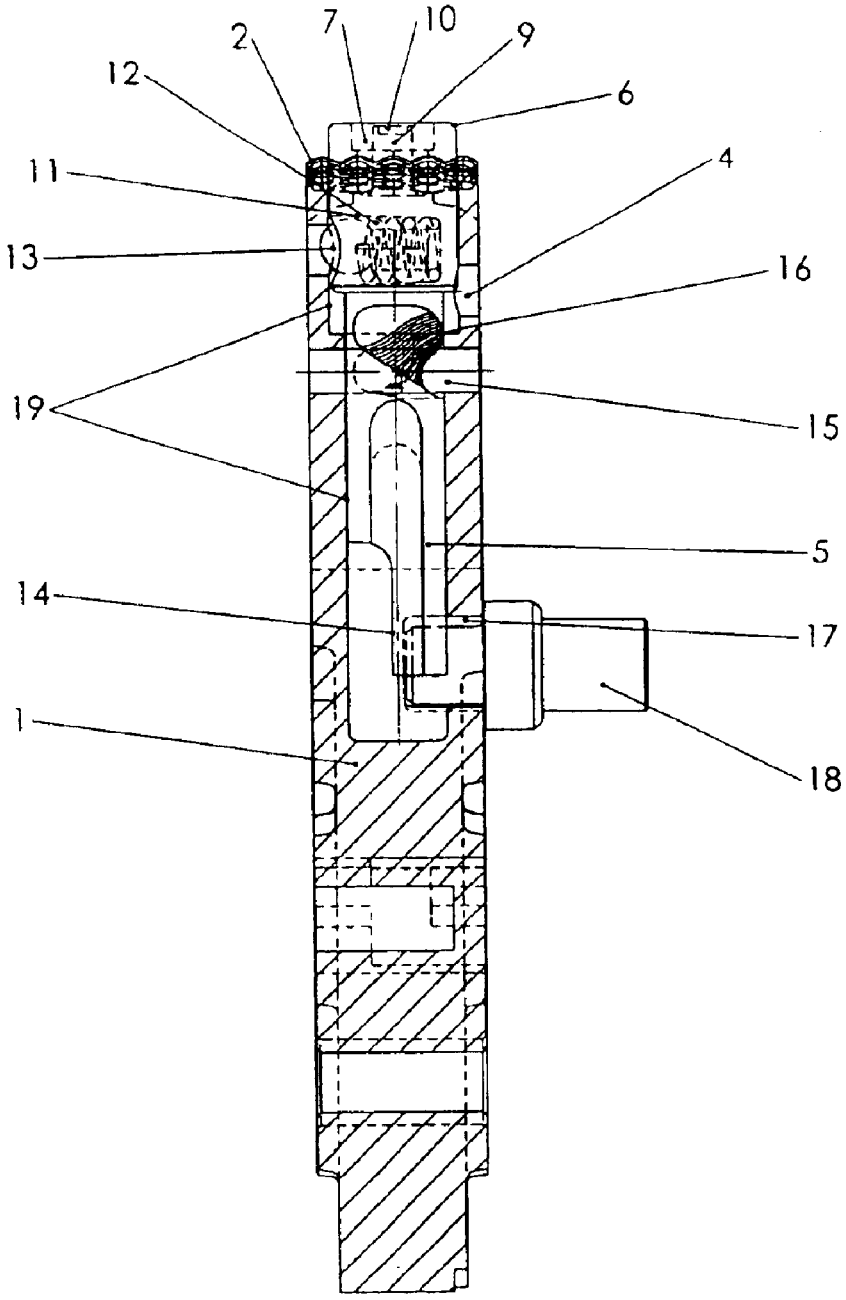
FIG. 6 is a front cut view of the hammer in the position represented by FIG. 5.

In the lower surface of the cylindrical body (5) of the safety, there is a lateral recess (14) which, depending on its turning, will allow the hammer to pass through the stopping pin (18) fixed over the frame, thus allowing movements of said hammer which cause gun shot, FIGS. 2 and 4. In FIGS. 5 and 6, the position of the lower edge with the recess (14) of the cylindrical body (5) of the safety is shown when turned 180° clockwise. Said edge will then interfere with the stopping pin (18) by avoiding to cock (1) the hammer under double or single action.

Figure 7:
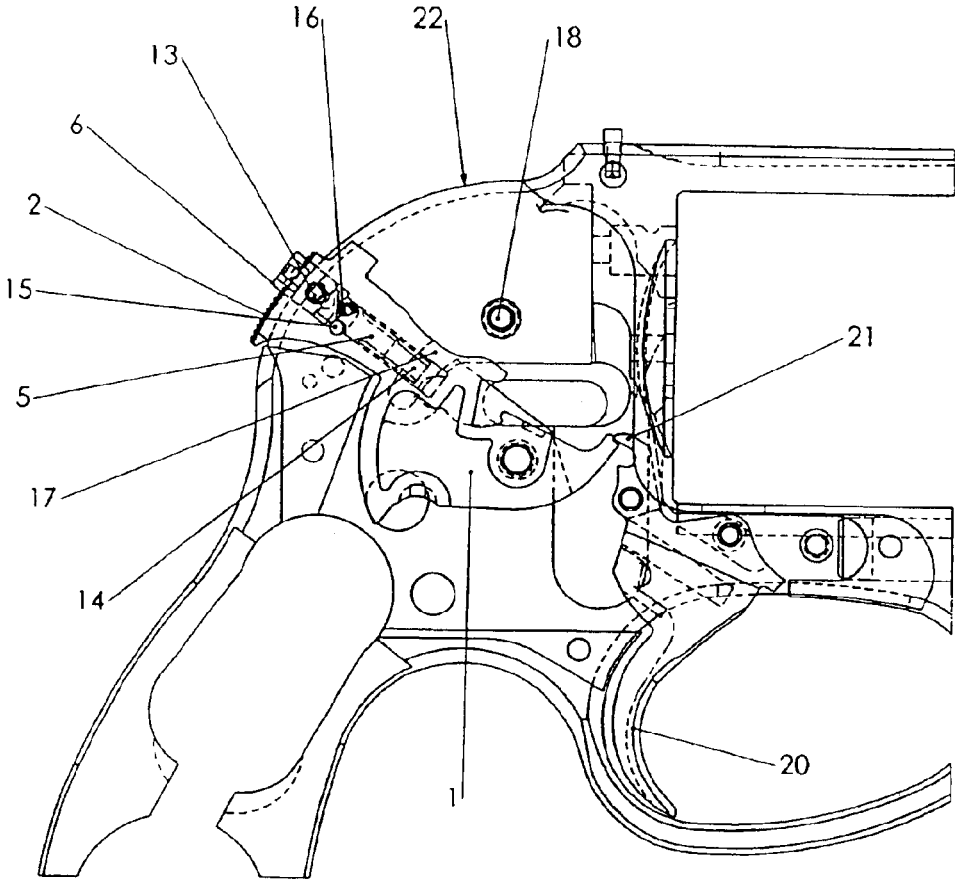
FIG. 7 is a view of the frame showing the hammer in its reward position, cocked and locked.
Figure 8:
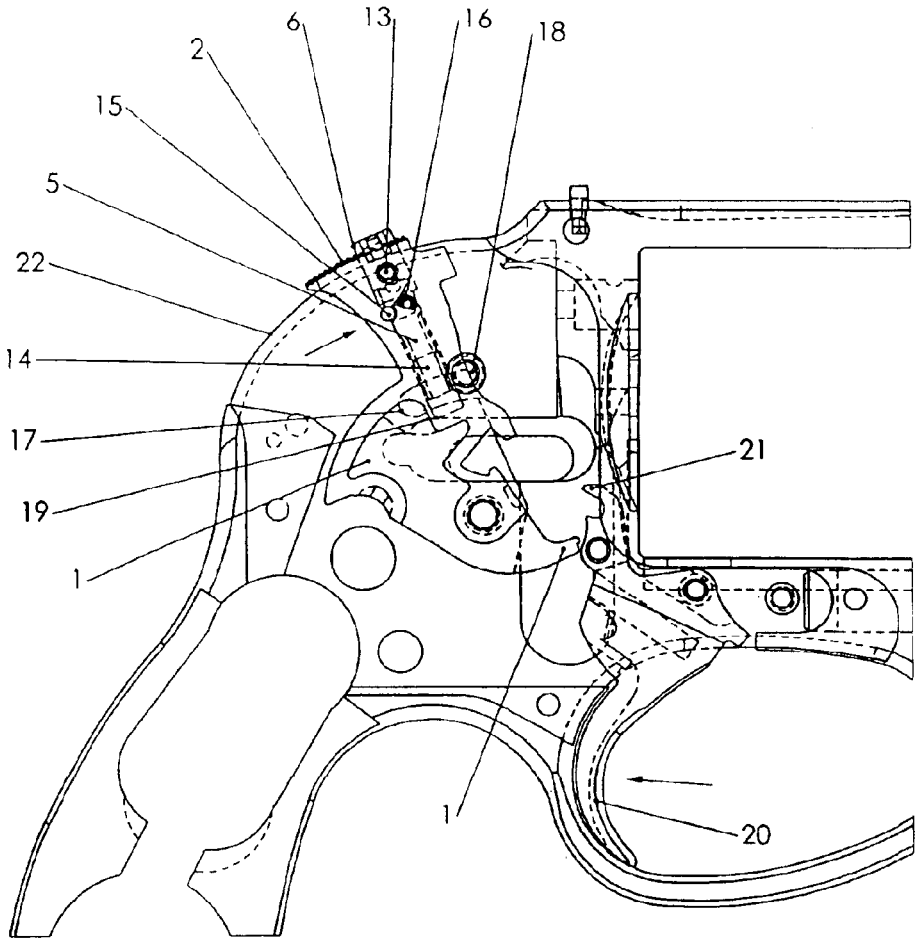
FIG. 8 is a view of the frame showing the activated trigger, releasing the locked hammer which movement will be restrained before percussion by the safety pin of the frame.

FIG. 7 shows the cocked gun by action of the thumb over the serrated head (2) of the hammer (1). If the gun is later locked, it cannot shot by any accidental touch on the trigger (20), since the course of the hammer (1) will be interrupted by the stopping pin (18) before percussion, when it interferes with the non-cut part of the lower edge of the safety body (5).

Figure 9:
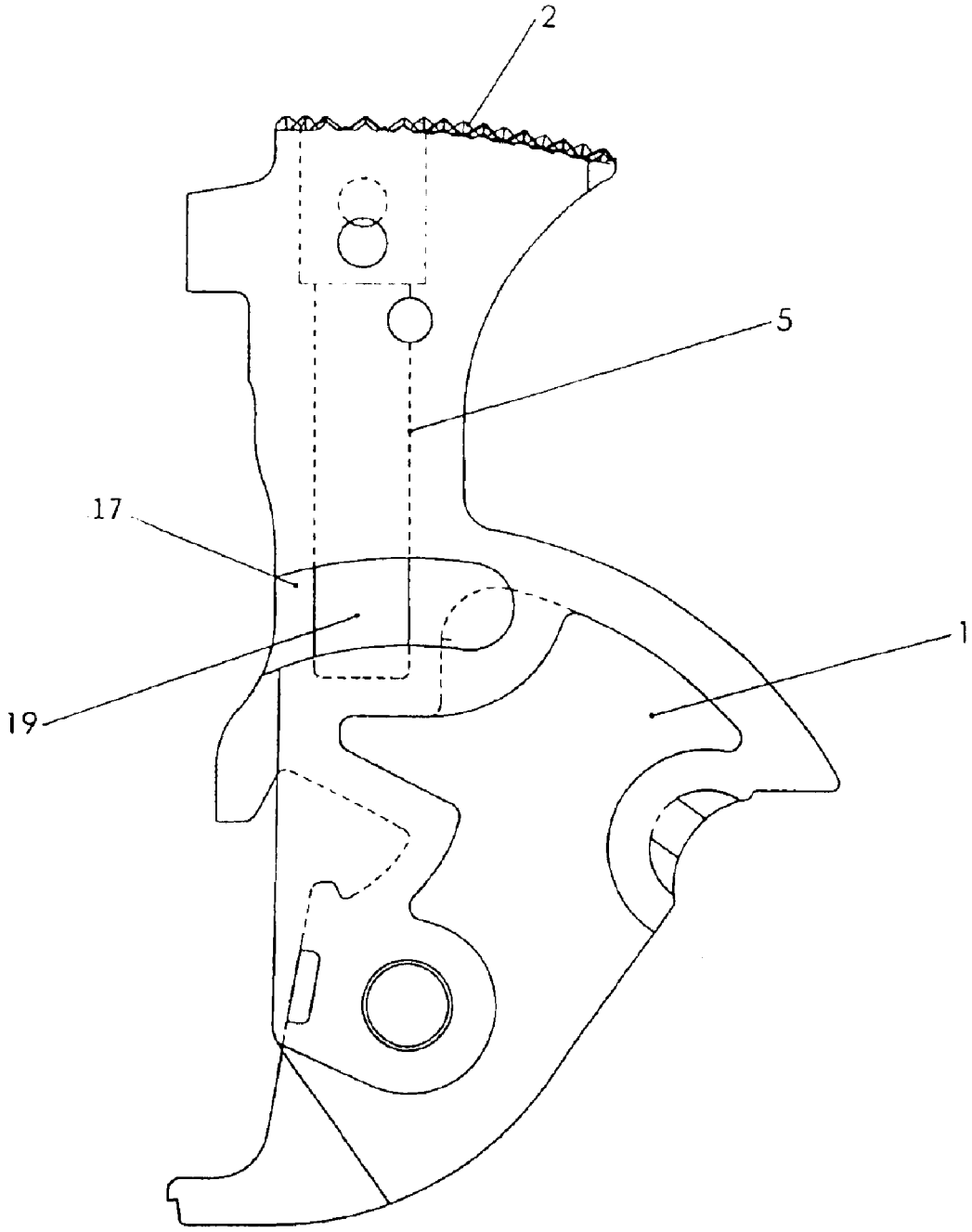
FIG. 9 is a left side view of the hammer in the uncocked position, in which the presence of the hole to pass the safety stopping pin becomes clear.

FIG. 9 shows the left side face of the hammer, in which there is a curved incision (17), which plain bottom is intercepted by the cylindrical hole (19) of the lodging for the cylindrical body (5) of said safety. It therefore becomes possible for the cylindrical edge of the stopping pin (18) projecting to inside the frame to interfere or not with the lower edge of the body (5) of the safety, depending if it is turned to its locked position or not.

FIG. 9 represents a left side view of the hammer in the uncocked position in which, if the safety is deactivated, there will be no interference between its body (5) and the stopping pin (18), since it will freely pass through the recess (14) of the edge of said body (5), when the hammer is in the reward position.

What is claimed is:

1. A revolver comprising a curved frame provided with a slot; a hammer having a top face, the hammer being movably mounted in the slot of the frame; and a safety device mounted in a longitudinal bore provided in the hammer for selectively preventing movement of the hammer for firing the revolver, the bore extends in a direction which is substantially perpendicular to the top surface of the hammer; the safety device comprises a locking pin movably mounted in the bore between a first position wherein the locking pin is flush with the top surface of the hammer and a second position wherein the locking pin protrudes above the top surface of the hammer, wherein the safety device prevents firing of the revolver when the locking pin is in the second position.

2. The revolver of claim 1, wherein the locking pin comprises an elongated cylindrical body comprising a head portion and a body portion, the body portion includes a helicodal groove which engages a cylindrical retentive pin which is fixed to the hammer and extends in a direction which is substantially perpendicular to the longitudinal direction of the bore, wherein rotation of the locking pin in a clockwise and counterclockwise direction results in movement of the locking pin between the first and second positions.

3. The revolver of claim 1, wherein a head portion of the locking pin has a top surface having an opening having a hexagonal portion.

4. The revolver of claim 3, wherein a cylindrical pin extends upward in the opening and has on the top surface thereof a small recess.

5. The revolver of claim 1, wherein the locking pin includes a radially extending non-through hole which receives a spring which selectively engage cavities provided in the hammer at diametrically opposed surfaces defining the bore.

6. The revolver of claim 5, wherein the cavities are at different heights with respect to the longitudinal direction of the bore.

7. The revolver of claim 1, wherein the locking pin is provided with a depression which allows for passage of a stopping pin mounted in the frame when the safety pin is in the second position.

8. The revolver of claim 7, wherein the hammer has a curved groove for receiving the stopping pin.

9. The revolver of claim 7, wherein the depression is located below a helicodal groove provided on the locking pin.

* * * * *